US007980216B2

(12) United States Patent
Elnick et al.

(10) Patent No.: US 7,980,216 B2
(45) Date of Patent: Jul. 19, 2011

(54) ROCKER ARM ASSEMBLY HAVING SLIDER ROLLER OIL PUMPING FEATURES

(75) Inventors: Rodney K. Elnick, Washington, MI (US); Ronald Jay Pierik, Holly, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 384 days.

(21) Appl. No.: 12/244,323

(22) Filed: Oct. 2, 2008

(65) Prior Publication Data

US 2009/0229554 A1 Sep. 17, 2009

Related U.S. Application Data

(60) Provisional application No. 61/036,655, filed on Mar. 14, 2008.

(51) Int. Cl.
*F01L 1/18* (2006.01)

(52) U.S. Cl. ..... 123/90.44; 384/286; 384/372; 384/377

(58) Field of Classification Search ..... 123/90.39, 123/90.44; 384/286–292, 372, 377
See application file for complete search history.

(56) References Cited

U.S. PATENT DOCUMENTS 6,220,758 B1 * 4/2001 Ono et al. ..... 384/286
2006/0062504 A1 * 3/2006 Wilton et al. ..... 384/475

* cited by examiner

*Primary Examiner* — Zalalem Eshete
(74) *Attorney, Agent, or Firm* — Harness, Dickey & Pierce, P.L.C.

(57) ABSTRACT

An engine assembly may include an engine structure, a rocker arm assembly supported by the engine structure, and a camshaft. The rocker arm assembly may include a lever body, a support member coupled to the lever body, and a first roller member supported for rotation on the support member. The first roller member may include an annular body having first and second axial ends and an inner bore. The inner bore may receive the support member and include a groove extending from the first axial end to the second axial end. The groove may include a first portion at the first axial end rotationally offset relative to a second portion at the second axial end of the annular body. The first roller member may be rotated by rotation of the camshaft and the groove may be adapted to pump oil along the bore when the first roller member is rotated.

20 Claims, 6 Drawing Sheets

FIG 4
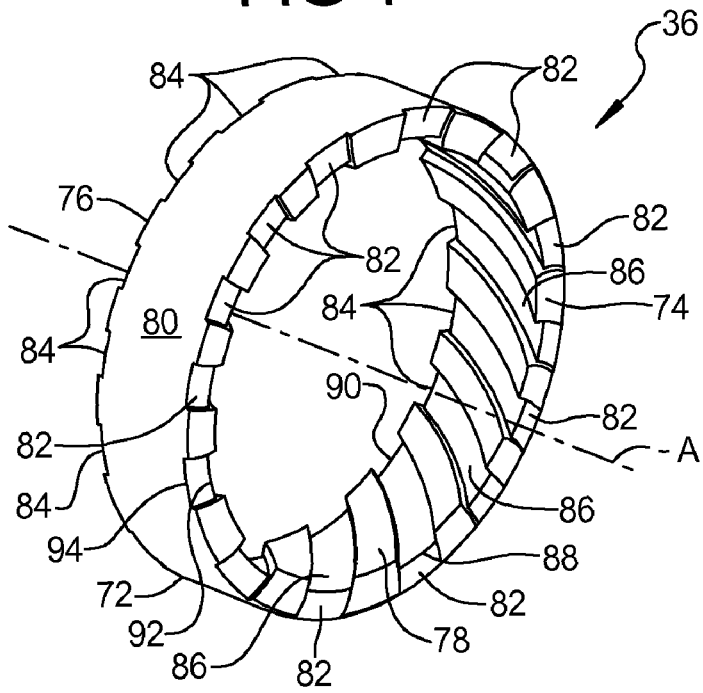
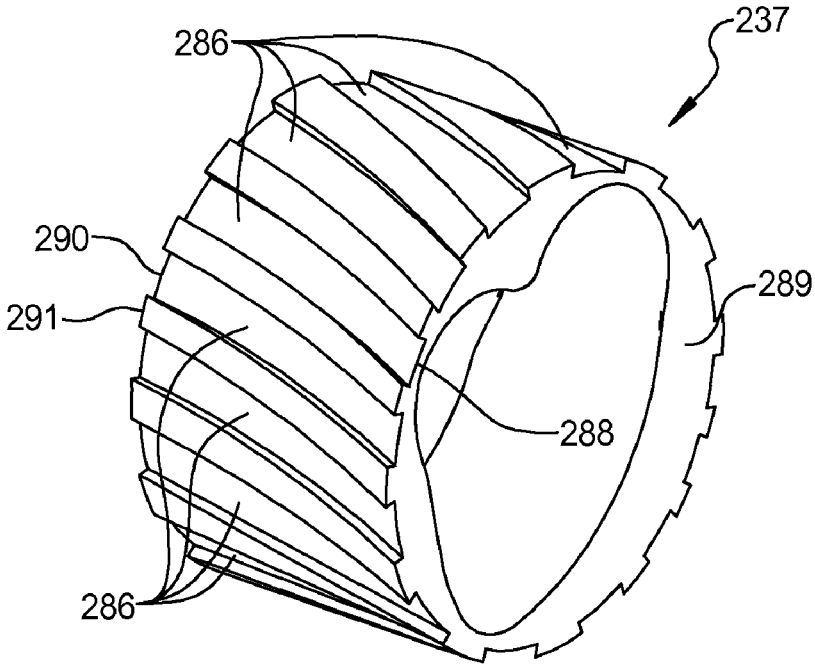
FIG 6

ROCKER ARM ASSEMBLY HAVING SLIDER ROLLER OIL PUMPING FEATURES

CROSS-REFERENCE TO RELATED APPLICATIONS

This application claims the benefit of U.S. Provisional Application No. 61/036,655, filed on Mar. 14, 2008. The disclosure of the above application is incorporated herein by reference.

FIELD

The present disclosure relates to rocker arm assemblies, and more specifically to lubrication of rocker arm assemblies.

BACKGROUND

The statements in this section merely provide background information related to the present disclosure and may not constitute prior art.

Engine rocker arm assemblies may include ring-like roller members to engage a camshaft and drive displacement of a valve. The roller members are typically supported on a shaft and bearing members, such as needle bearings may be located between the shaft and the roller member. The inclusion of the needle bearings may reduce a radial thickness of the roller member due to packaging constrains. Removal of the needle bearings may create lubrication concerns for the interface between the shaft and the roller member.

SUMMARY

An engine assembly may include an engine structure, a rocker arm assembly, and a camshaft. The rocker arm assembly may be supported by the engine structure and may include a lever body, a support member coupled to the lever body, and a first roller member supported for rotation on the support member. The first roller member may include an annular body having first and second axial ends and an inner bore. The inner bore may receive the support member and include a groove extending from the first axial end to the second axial end. The groove may include a first portion at the first axial end rotationally offset relative to a second portion at the second axial end of the annular body. The camshaft may be rotatably supported on the engine structure and may include a first lobe engaged with the first roller member. The first roller member may be rotated by rotation of the camshaft and the groove may be adapted to pump oil along the bore when the first roller member is rotated.

An alternate rocker arm assembly may include a lever body, a support member coupled to the lever body, and a first roller member adapted to engage a camshaft and having a bore supported for rotation on the outer radial surface of the support member. The support member may include first and second axial ends and an outer radial surface. The outer radial surface may include a groove extending from the first axial end to the second axial end and having a first portion at the first axial end rotationally offset relative to a second portion at the second axial end. The groove may be adapted to pump oil along the bore when the first roller member is engaged with the camshaft to rotate the first roller member relative to the support member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 4 is a perspective view of a first roller member of the rocker arm assembly of FIG. 2;

FIG. 6 is a perspective view of an alternate support member of a rocker arm assembly according to the present disclosure;

DETAILED DESCRIPTION

Figure 1:
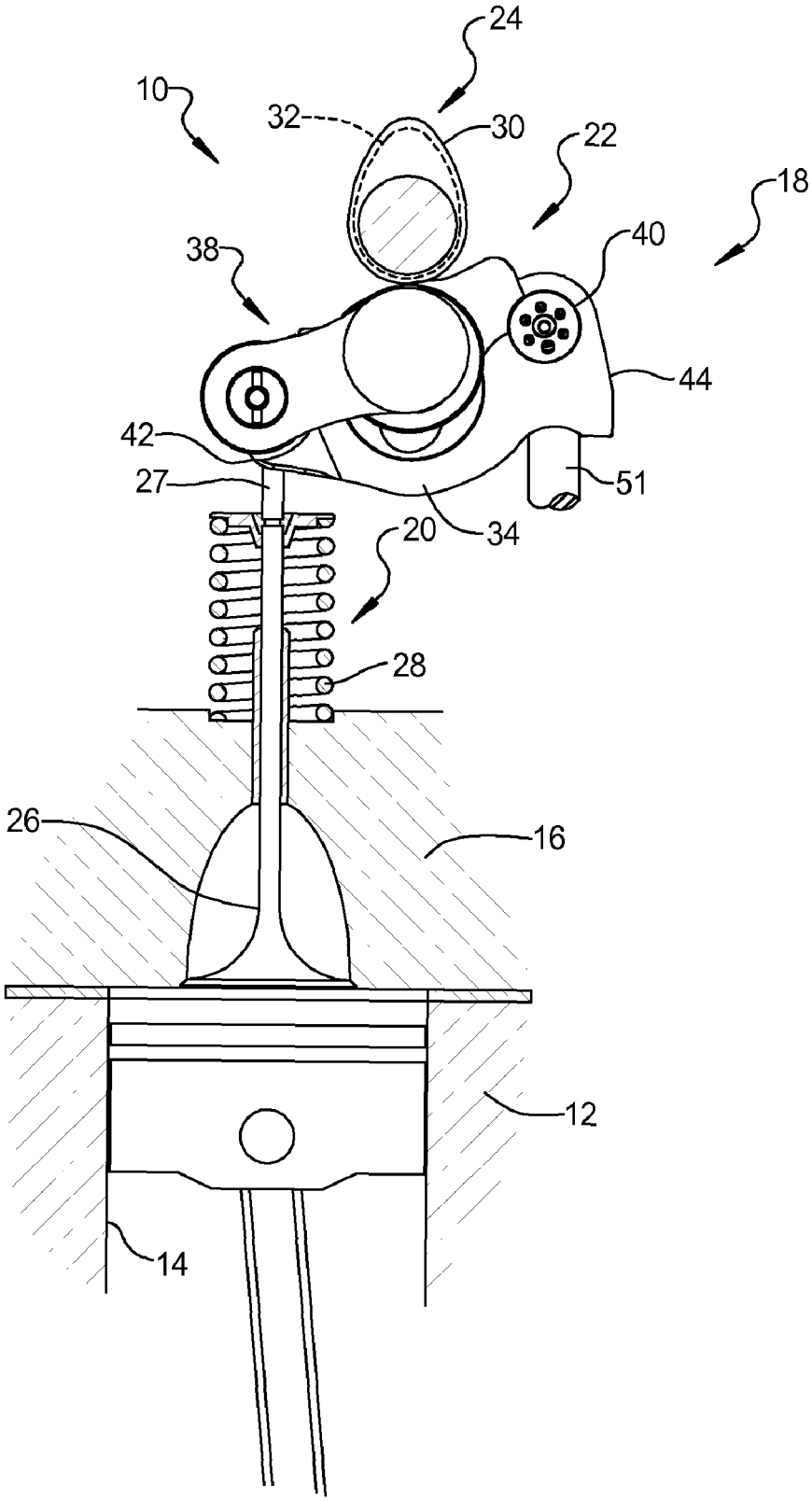
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, an engine assembly 10 is illustrated. The engine assembly 10 may have an engine structure including an engine block 12 defining a plurality of cylinders 14 (one of which is shown), a cylinder head 16 mounted to the engine block 12 and overlying the cylinders 14, and a valve train 18. The valve train 18 may be coupled to a portion of the engine structure such as the cylinder head 16.

The valve train 18 may include a valve assembly 20, a rocker arm assembly 22, and a camshaft 24. The valve assembly 20 may include a valve member 26 and a biasing member 28. The valve member 26 may include an end portion 27 engaged with the rocker arm assembly 22. The biasing member 28 may include a compression spring and may bias the valve member 26 to a closed position. The rocker arm assembly 22 may be pivotally coupled to the engine structure. The camshaft 24 may include a set of first lobes 30 (one of which is shown) and a second lobe 32 engaged with the rocker arm assembly 22 to displace the valve member 26.

The rocker arm assembly 22 may be a multi-step rocker arm assembly, for example, a two-step rocker arm assembly. With additional reference to FIG. 2, the rocker arm assembly 22 may include a lever body 34, a first roller member 36, a support member 37 (seen in FIG. 3), an arm assembly 38, and a locking mechanism 40. The lever body 34 may include a first end 42, a second end 44, and a medial portion 46 having first and second portions 47, 49 located between the first and second ends 42, 44. The first end 42 may include a first opening 48. As seen in FIG. 3, the second end 44 may include a second opening 50, a recess 52, and an oil passage 54 in communication with the second opening 50 and the recess 52. The first end 42 may be engaged with the end portion 27 of the valve member 26 (seen in FIG. 1) for actuation of the valve member 26. The recess 52 in the second end 44 may be engaged with and pivotally supported by a support member 51 (seen in FIG. 1). The recess 52 may be in communication with a pressurized oil source from a valve train component. For example, the support member 51 may include a hydraulic lash adjuster and the lash adjuster may provide pressurized oil to the recess 52. The first roller member 36 may be fixed for pivotal displacement with the lever body 34 at the medial portion 46.

Figure 2:
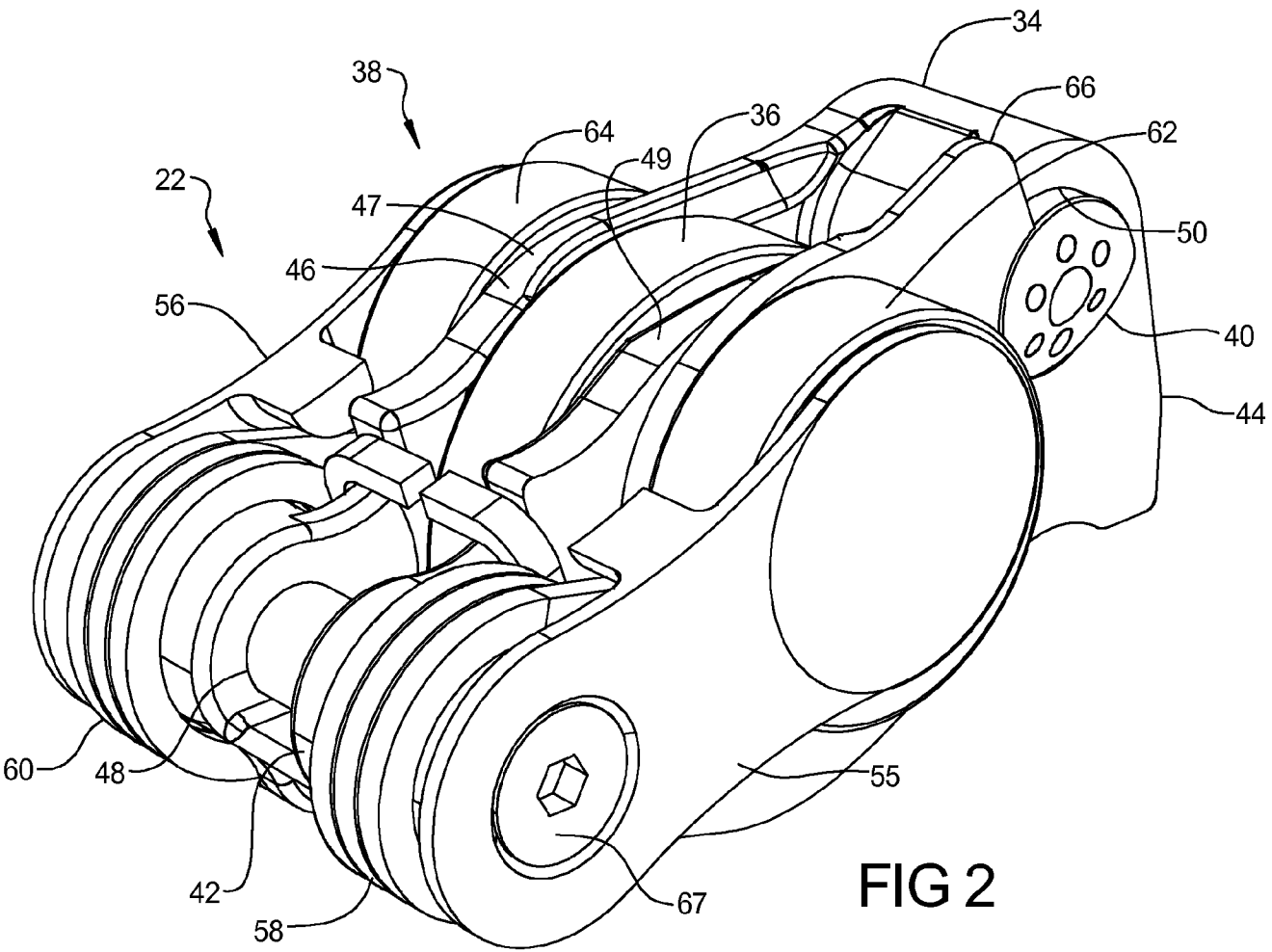
FIG. 2 is a perspective view of a rocker arm assembly shown in FIG. 1.
Figure 3:
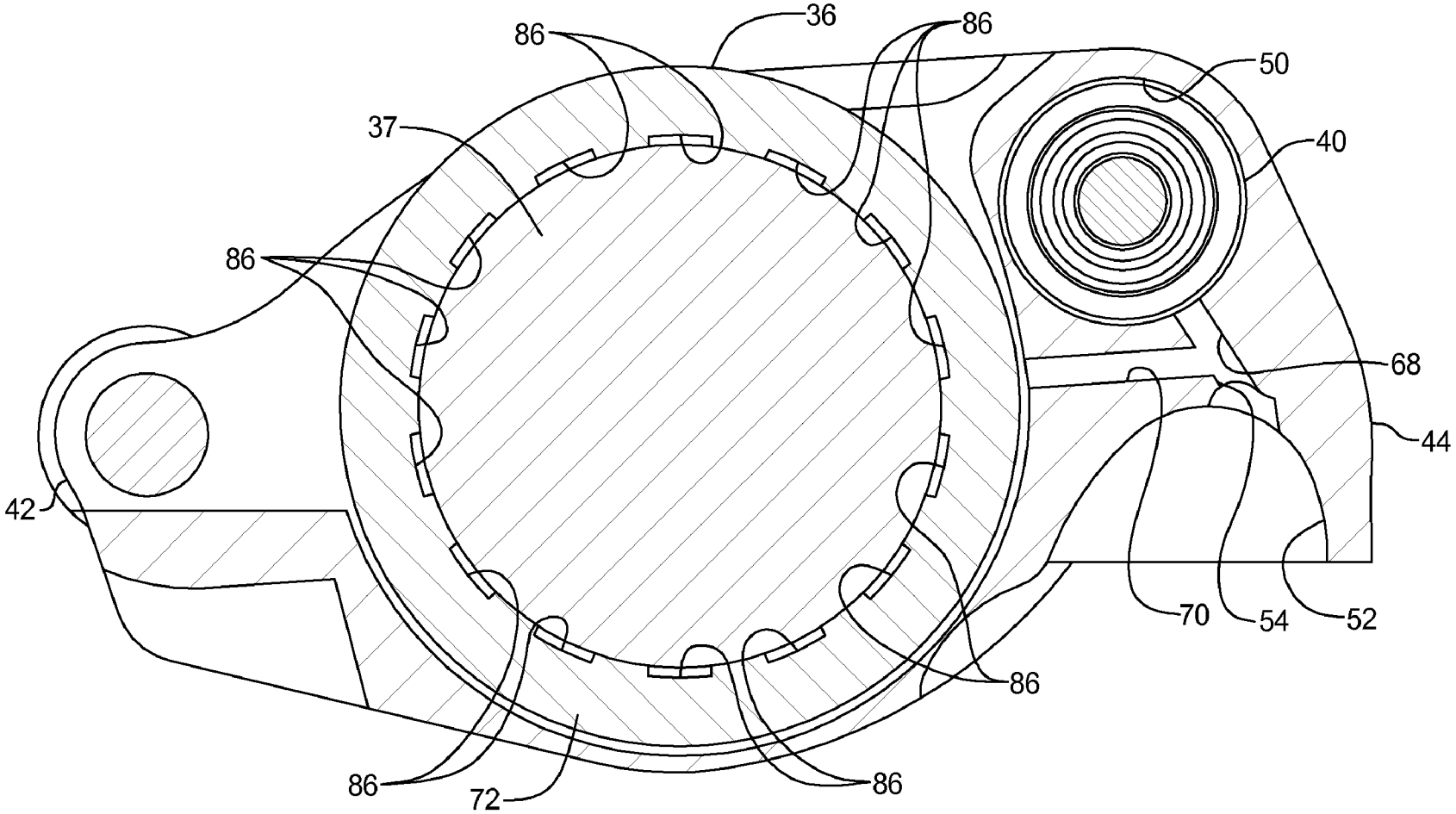
FIG. 3 is a section view of the rocker arm assembly of FIG. 2.

With reference to FIG. 2, the arm assembly 38 may include first and second arms 55, 56, first and second biasing members 58, 60, second and third roller assemblies 62, 64, a latch 66, and a fastener 67. The fastener 67 may extend through first ends of the first and second arms 55, 56 and the first opening 48 in the lever body 34 to pivotally couple the arm assembly 38 to the lever body 34. The second roller assembly 62 may be coupled to a second end of the first arm 55 and the third roller assembly 64 may be coupled to a second end of the second arm 56. The first and second arms 55, 56, the second and third roller assemblies 62, 64, and the latch 66 may each be fixed for pivotal displacement with one another. The first biasing member 58 may be engaged with the first arm 55 and the lever body 34 and the second biasing member 60 may be engaged with the second arm 56 and the lever body 34. The first and second biasing members 58, 60 may include torsion springs and may bias the arm assembly 38 against the first lobes 30.

The locking mechanism 40 may be located in the second opening 50 of the lever body 34. As seen in FIG. 3, the lever body 34 may include first and second oil passages 68, 70 in communication with the recess 52. The first oil passage 68 may provide oil to actuate the locking mechanism 40 and the second oil passage 70 may provide lubrication to the first roller member 36. Alternatively, the lever body 34 may include a single oil passage, such as the first oil passage 68, and the first roller member 36 may be lubricated by splash lubrication.

As seen in FIGS. 2-4, the first roller member 36 may be supported for rotation on the support member 37 and located between the first and second portions 47, 49 of the lever body 34. The first roller member 36 may include an annular body 72 having first and second axial ends 74, 76, an inner bore 78, and an outer radial surface 80. The first axial end 74 may include a first series of recesses 82 and the second axial end 76 may include a second series of recesses 84. The inner bore 78 may include a series of grooves 86 extending from the first axial end 74 to the second axial end 76. The grooves 86 may be similar to one another and may each be in communication with one of the first recesses 82 and one of the second recesses 84. Therefore, a single first recess 82, second recess 84, and groove 86 will be discussed below, with the understanding that the description applies equally to the remainder of the first and second recesses 82, 84 and grooves 86.

The groove 86 may include a first portion 88 at the first axial end 74 in communication with the first recess 82 and a second portion 90 at the second axial end 76 in communication with the second recess 84. The groove 86 may have an outward radial extent (or depth) of at least 0.1 millimeters (mm). In the present non-limiting example, the groove 86 may have an outward radial extent of between 0.5 mm and 1.0 mm. The first and second portions 88, 90 may be rotationally offset relative to one another. For example, the groove 86 may have a spiral shape or may extend linearly at an angle relative to the rotational axis (A), seen in FIG. 4, of the first roller member 36. The groove 86 may extend at an angle of between ten and forty-five degrees relative to the rotational axis (A) of the first roller member 36. The first recess 82 may extend at an angle radially outward from the inner bore 78 to the outer radial surface 80. The inner end 92 of the first recess 82 may be rotationally offset relative to the outer end 94 of the first recess 82. For example, the first recess 82 may have a spiral shape. The second recess 84 may be generally similar to the first recess 82, but with a generally opposite angular (or spiral) orientation.

While each of the grooves 86 and first and second recesses 82, 84 are described above as having angled orientations, or spiral shapes, it is understood that the present teachings are not limited to this arrangement. For example, the first recesses 82 may have the inner and outer ends 92, 94 rotationally aligned with one another and the grooves 86 may extend generally linearly and parallel to the rotational axis (A) of the first roller member 36, while the second recesses 84 maintain the orientation discussed above with reference to FIG. 4. Alternatively, the first recesses 82 may maintain the orientation discussed above with reference to FIG. 4 while the second recesses 84 are arranged with the inner and outer ends rotationally aligned. In a further non-limiting example, the grooves 86 may maintain the angular, or spiral, orientation discussed above with reference to FIG. 4 while the first recesses 82 have their inner and outer ends 92, 94 rotationally aligned with one another and the second recesses 84 have their inner and outer ends rotationally aligned with one another.

During operation, the first roller member 36 may rotate relative to the support member 37. The first roller member 36 may be rotatably supported directly on the support member 37 without the use of roller bearings. The first and second recesses 82, 84 and grooves 86 may generally provide for lubrication between the bore 78 of the roller member 36 and the support member 37. More specifically, the first and second recesses 82, 84 and grooves 86 may pump oil provided by the second oil passage 70 and/or from splash lubrication.

Figure 7:
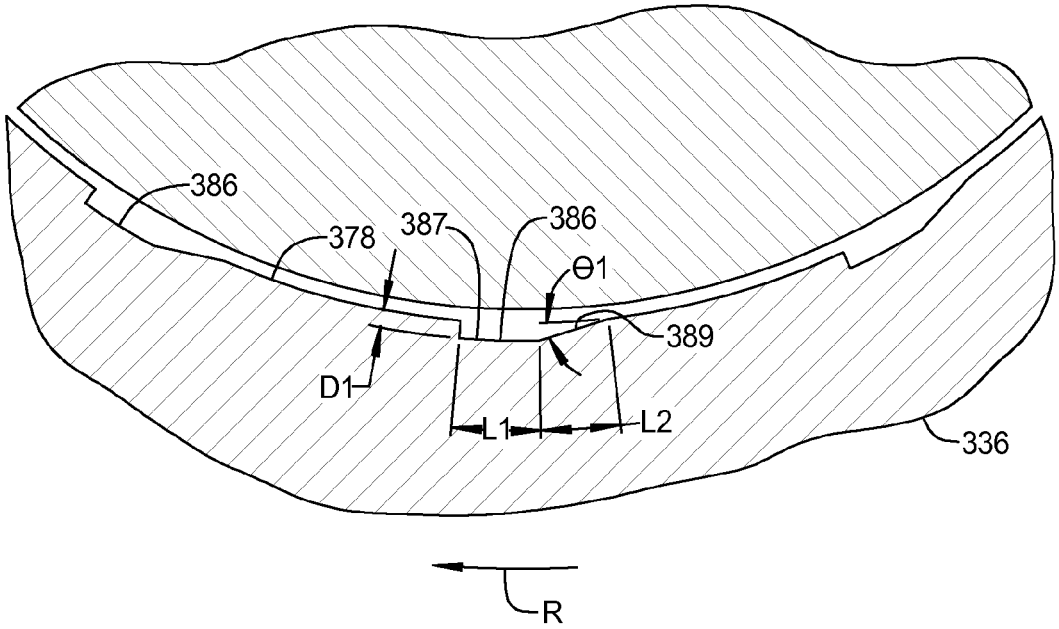
FIG. 7 is a fragmentary section view of an alternate roller member and support member of a rocker arm assembly according to the present disclosure.

While the grooves 86 in the first roller member 36 are shown in FIG. 3 as having a generally rectangular cross-section, it is understood that other configurations may be used as well. By way of non-limiting example, as seen in FIG. 7, the first roller member 336 may include alternate grooves 386 in place of the grooves 86. The grooves 386 may each include first and second portions 387, 389. The first portion 387 may have a depth (D1) of at least 0.25 mm and may have a circumferential extent (L1) of between 1.0 mm and 3.0 mm. The second portion 389 may extend from the base of the first portion 387 to the inner bore 378 of the first roller member 336 at an angle (θ1). The angle (θ1) may be between 1 degree and 30 degrees. More specifically, the angle (θ1) may be between 15 degrees and 20 degrees. The second portion 389 may have a circumferential extent (L2) approximately equal to the circumferential extent of the first portion 387. For example, the second portion 389 may have a circumferential extent (L2) of between 1.0 mm and 3.0 mm. As the first roller member 336 rotates in the rotational direction (R), the oil within the groove 386 is compressed as it travels within the groove 386 from the first portion 387 to the second portion 389.

Figure 8:
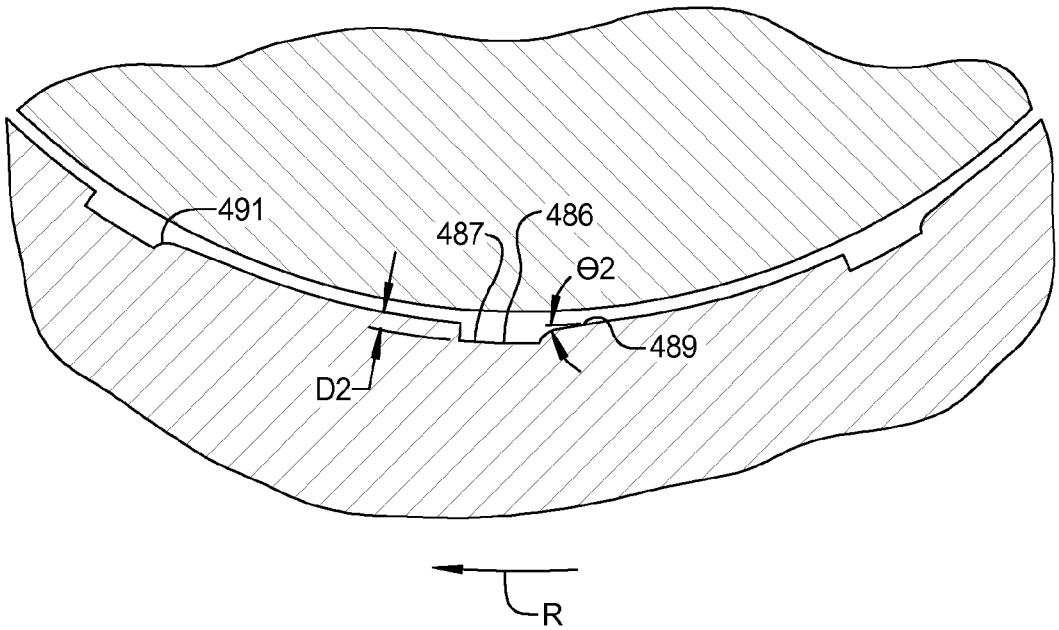
FIG. 8 is a fragmentary section view of an alternate roller member and support member of a rocker arm assembly according to the present disclosure.

Alternatively, as seen in FIG. 8, the second portion 489 of the groove 486 may extend at an angle (θ2) at a location between the base of the first portion 487 and the inner bore 478 at a distance (D2) from the base of the first portion 487. By way of non-limiting example, the distance (D2) may be greater than twenty-five percent of the distance (D1) shown in FIG. 7. Further, the transition between the first and second portions 487, 489 may include a radius 491.

Figure 5:
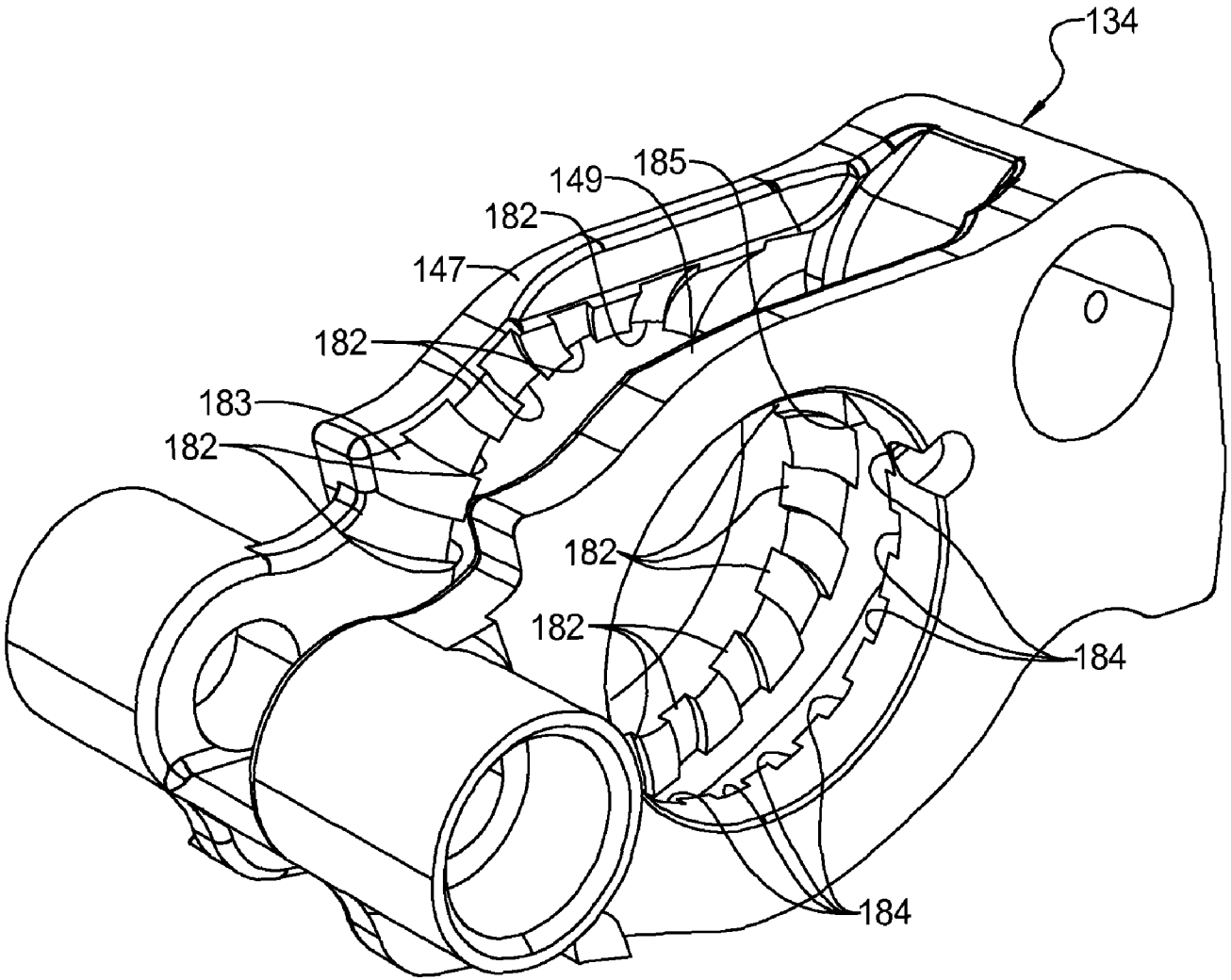
FIG. 5 is a perspective view of an alternate lever body of a rocker arm assembly according to the present disclosure.

In an alternate arrangement seen in FIG. 5, a lever body 134 may be used in place of the lever body 34 in the rocker arm assembly 22. The lever body 134 may include recesses 182 generally similar to recesses 82 on the first roller member 36.

The recesses 182 may be located on an inner surface 183 of the first portion 147 of the lever body 134. The second portion 149 of the lever body 134 may include recesses 184 on an inner surface 185 thereof as well. The recesses 182, 184 may provide for transfer of oil to and from the grooves 86 of the first roller member 36. The recesses 182, 184 may be of opposite spiral orientation relative to one another to maximize the oil pumping effect.

In another alternate arrangement seen in FIG. 6, a support member 237 may be used in place of the support member 37 in the rocker arm assembly 22. The support member 237 may include grooves 286 in the outer radial surface thereof. The grooves 286 on the support member 237 may be used in place of the grooves 86 on the first roller member 36. The grooves 286 may be generally similar to the grooves 86, each having a first portion 288 at a first axial end 289 of the support member 237 and a second portion 290 at a second axial end 291 of the support member 237. The first portion 288 for a given groove 286 may be rotationally offset relative to the second portion 290 of the given groove 286. Additionally, the grooves 286 may include a spiral shape and may pump oil when the camshaft 24 engages a roller member to rotate the roller member relative to the support member 237. The support member 237 may be used in combination with the lever body 134 shown in FIG. 5. Therefore, the grooves 286 may be in communication with the recesses 182 in the lever body 134.

It is understood that while described as being incorporated into a multi-step rocker arm assembly 22, the present teachings could be used in a variety of other rocker arm assemblies. For example, the present teachings may be used in fixed lift rocker arm assemblies.

What is claimed is:

1. A rocker arm assembly comprising:

a lever body;

a support member coupled to the lever body; and a first roller member supported for rotation on the support member and adapted to engage a camshaft and including an annular body having first and second axial ends and an inner bore, the inner bore receiving the support member and including a groove extending from the first axial end to the second axial end and having a first portion defining an oil inlet at the first axial end rotationally offset relative to a second portion defining an oil outlet at the second axial end, the groove adapted to pump oil along the bore from the first axial end to the second axial end when the first roller member is rotated by engagement with the camshaft.

2. The rocker arm assembly of claim 1, wherein the groove includes a spiral shape.

3. The rocker arm assembly of claim 1, wherein a first axial end surface of the first axial end includes a first recess in communication with the first portion of the groove.

4. The rocker arm assembly of claim 3, wherein the first recess extends from an outer radial surface of the annular body to the inner bore.

5. The rocker arm assembly of claim 4, wherein the first recess includes a first end at the outer radial surface that is rotationally offset relative to a second end of the recess at the inner bore of the first roller member.

6. The rocker arm assembly of claim 1, wherein the lever body includes a first portion having an inner surface adjacent the first axial end of the first roller member, the inner surface including a recess in communication with the groove in the first roller member.

7. The rocker arm assembly of claim 1, wherein the inner bore of the first roller member is directly supported on the support member, the groove providing lubrication at an interface between the support member and the inner bore.

8. The rocker arm assembly of claim 1, wherein the lever body includes an oil passage providing oil flow to an outer radial surface of annular body.

9. A rocker arm assembly comprising:

a lever body;

a support member coupled to the lever body having first and second axial ends and an outer radial surface, the outer radial surface including a groove extending from the first axial end to the second axial end and having a first portion defining an oil inlet at the first axial end rotationally offset relative to a second portion at defining an oil outlet at the second axial end; and a first roller member adapted to engage a camshaft and having a bore supported for rotation on the outer radial surface of the support member, the groove adapted to pump oil along the bore from the first axial end to the second axial end when the roller first member is engaged with the camshaft to rotate the first roller member relative to the support member.

10. The rocker arm assembly of claim 9, wherein the groove includes a spiral shape.

11. The rocker arm assembly of claim 9, wherein the lever body includes a first portion having an inner surface adjacent the first axial end of the support member, the inner surface including a recess in communication with the groove in the support member.

12. The rocker arm assembly of claim 9, wherein the inner bore of the first roller member is directly supported on the outer radial surface of the support member, the groove providing lubrication at an interface between the support member and the inner bore.

13. An engine assembly comprising:

an engine structure;

a rocker arm assembly supported by the engine structure and including:

a lever body;

a support member coupled to the lever body; and a first roller member supported for rotation on the support Member and including an annular body having first and second axial ends and an inner bore, the inner bore receiving the support member and including a groove extending from the first axial end to the second axial end and having a first portion defining an oil inlet at the first axial end rotationally offset relative to a second portion defining an oil outlet at the second axial end; and a camshaft rotatably supported on the engine structure and including a first lobe engaged with the first roller member, the first roller member rotated by rotation of the camshaft, the groove adapted to pump oil along the bore from the first axial end to the second axial end when the first roller member is rotated.

14. The engine assembly of claim 13, wherein the groove includes a spiral shape.

15. The engine assembly of claim 13, wherein a first axial end surface of the first axial end includes a first recess in communication with the first portion of the groove.

16. The engine assembly of claim 15, wherein the first recess extends from an outer radial surface of the annular body to the inner bore.

17. The engine assembly of claim 16, wherein the first recess includes a first end at the outer radial surface that is rotationally offset relative to a second end of the recess at the inner bore of the first roller member.

18. The engine assembly of claim 13, wherein the lever body includes a first portion having an inner surface adjacent the first axial end of the first roller member, the inner surface including a recess in communication with the groove in the first roller member.

19. The engine assembly of claim 13, wherein the inner bore of the first roller member is directly supported on the support member, the groove providing lubrication at an interface between the support member and the inner bore.

20. The engine assembly of claim 13, wherein the lever body includes an oil passage providing oil flow to an outer radial surface of annular body.

* * * * *